US005441431A

United States Patent [19]

Brogdon

[11] Patent Number: 5,441,431

[45] Date of Patent: Aug. 15, 1995

[54] FRESH WATER FLUSHING SYSTEM

[76] Inventor: Douglas Brogdon, 10570 Front Beach Rd., Panama City Beach, Fla. 32407

[21] Appl. No.: 201,269

[22] Filed: Feb. 24, 1994

Related U.S. Application Data

[63] Continuation-in-part of Ser. No. 79,877, Jun. 23, 1993, abandoned.

[51] Int. Cl.[6] ..... B63H 21/10

[52] U.S. Cl. ..... 440/88

[58] Field of Search ..... 440/88, 113, 900; 134/166 R, 169 A, 167 R, 165 R; 114/122; 137/494, 541, 538, 542, 543.13; 165/95; 123/41.14, 198 A

[56] References Cited

U.S. PATENT DOCUMENTS

| | | | |
|---|---|---|---|
| 2,206,356 | 7/1940 | Hutchings | 137/538 |
| 3,001,546 | 9/1961 | Salisbury | 137/541 |
| 3,067,770 | 12/1962 | Fancher | 137/493 |
| 3,267,959 | 8/1966 | Savage | 137/516.11 |
| 3,441,044 | 4/1969 | Rodriguez | 137/516.11 |
| 3,756,273 | 9/1973 | Hengesbach | 137/540 |
| 4,083,399 | 4/1978 | Babish et al. | 134/169 A |
| 4,176,708 | 12/1979 | Joffe | 134/169 A |
| 4,276,914 | 7/1981 | Albertson | 134/169 A |
| 5,257,604 | 11/1993 | Vatarv et al. | 134/169 A |

FOREIGN PATENT DOCUMENTS

| | | | |
|---|---|---|---|
| 2302355 | 8/1974 | Germany | 137/538 |

*Primary Examiner*—Edwin L. Swinehart
*Attorney, Agent, or Firm*—Carnes, Cona, and Dixon

[57] ABSTRACT

A fresh water flushing system for a marine engine in a boat for use whether the boat is in or out of the water is disclosed. The system comprises a control panel mounted on the interior of the boat, a plurality of tubular T-shaped interconnection fittings in a raw sea water cooling conduit, and a fresh water flush valve. The components are connected for fresh water fluid flow. The fresh water flush valve has valve plunger for establishing fresh water flow between the control panel and the T-shaped interconnection fittings.

10 Claims, 11 Drawing Sheets

FRESH WATER FLUSHING SYSTEM

This application is a continuation-in-part of parent application No. 08/079,877 filed on Jun. 23, 1993.

BACKGROUND OF THE INVENTION

1. Field of the Invention

The present invention relates to a fresh water flushing system for marine engines, and in particular to a fresh water flushing system that expels entrained sea water from a raw sea water cooling conduit of the marine engine, whether the boat is in or out of the water, and irrespective of whether the engine is running or is shut off.

2. Description of the Prior Art

Efforts are constantly being taken to improve fresh water flushing systems for marine engines. Fresh water flushing is recommended universally by every marine engine manufacturer. Flushing fresh water through a marine engine substantially prolongs the life of the equipment, lowers the maintenance costs, and protects the significant investment in the engine itself.

Current systems treat the cooling system as a single cavity, as opposed to a group of cavities, water pathways, and equipment. Traditional flushing systems currently available are time consuming to use, error prone, and in many cases just not feasible to use for commercial crafts or pleasure crafts.

For example, most flushing devices cannot be use if the boat is lifted from the water by a davit or is stored in a boathouse. Current flushing equipment usually requires The engine to be running while the boat is in the water. Under certain condition, flushing the engine can be hazardous. The current flushing systems have limitations on convenience and reliability the make them user unfriendly. Most current systems merely relocate salt and mineral residues to other locations within the cooling system.

None of these previous efforts, however, provide the benefits intended with the present invention. Additionally, prior techniques do not suggest the present inventive combination of component elements as disclosed and claimed herein. The present invention achieves its intended purposes, objectives, and advantages over the prior art devices through a new, useful, and non-obvious combination of component elements. The invention is simple to use, utilizes a minimum number of functioning parts, is inexpensive to manufacture, assemble, test and employs only readily available material.

SUMMARY OF THE INVENTION

The present invention is defined by the appended claims with the specific embodiment shown in the attached drawings. For the purpose of summarizing the invention, the invention may be incorporated into a fresh water flushing system for displacing sea water in a marine engine whether the boat is in or out of the water. The fresh water flushing system comprises a control panel mounted on an interior of the boat having a fresh water supply connection and a gate valve for regulating the flow for fresh water, a fresh water flush valve having an inlet port for receiving the flow of fresh water, a plurality of axial outlet ports for proportionally discharging the flow of fresh water, and a fresh water conduit therebetween.

In addition, the system also has a plurality of tubular T-shape fittings interconnecting the fresh water flush valve to a raw sea water conduit on the marine engine, and a plurality of flexible hoses therebetween for establishing fluid communication between each one of the axial outlet ports and one of the tubular T-shaped fittings.

The present invention may be incorporated in several types of marine engines. These engines include inboard/outboard engines, V-8 stern drives, jet skis, and other similar engines. The invention may be incorporated into existing engine systems.

Therefore, it is an object of the present invention to provide a fresh water flushing system to expel entrained sea water from a raw sea water cooling conduit of a marine engine whether the boat is in or out of the water.

It is another object of the present invention to provide a fresh water flushing system that works with a variety of marine engines including inboard/outboard engines, V8 stern drive engines, jet skis, and the like.

It is another object of the present invention to provide a fresh water flushing system that can be easily retrofitted into existing engine systems.

It is another object of the present invention to provide a fresh water flushing system that proportions the flow of fresh water to each sub-system and component of the cooling system to insure correct filling and draining of harmful minerals and salts and other residues from the cooling system.

It is another object of the present invention to provide a fresh water flushing system that can be easily incorporated as an original equipment manufactured (OEM) component for newly manufactured boats.

It is another object of the present invention to provide a fresh water flushing system that will resist the corrosive effects of salt air and sea water on the fixed and movable working parts of the invention.

It is another object of the present invention to provide a fresh water flushing system that will not impair the operational performance of the marine engine the marine engine is operating in the water when and the fresh water flushing system is not in use.

It is a final object of the present invention to be specifically enumerated herein to provide a fresh water flushing system in accordance with the preceding objects and which will conform to conventional forms of manufacture, be of simple construction, and be easy to use so as to provide a device that will be economically feasible, long lasting and relatively trouble free in operation, and will provide superior flushing performance.

The foregoing has outlined some of the more pertinent objects of the invention. These objects should be construed to be merely illustrative of some of the more prominent features and applications of the intended invention. Many other beneficial results can be obtained by applying the disclosed invention within the scope of the disclosure. Accordingly, other objects and a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

A DESCRIPTION OF THE PREFERRED EMBODIMENTS

Figure 1:
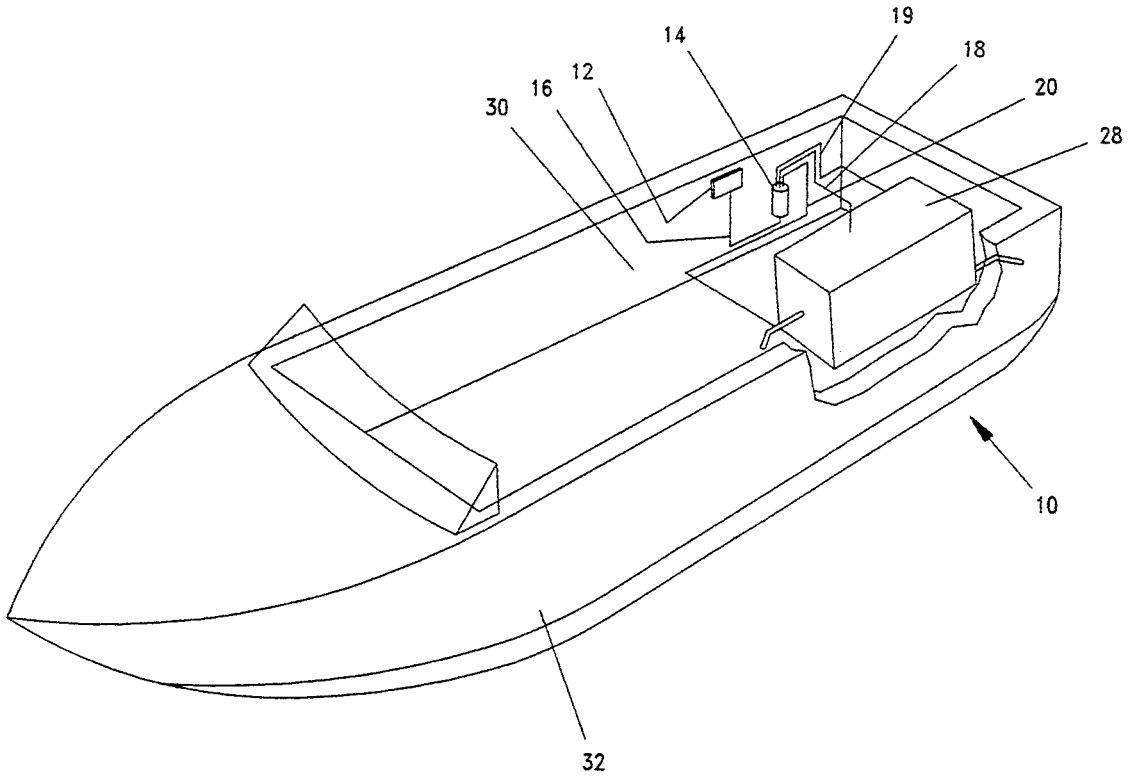
FIG. 1 is a perspective view of the present invention in an inboard embodiment showing the relative location of the system to the inboard mounted motor.

FIG. 1 illustrates the flushing system 10 of the present invention installed in an inboard embodiment. As shown in FIG. 1, the flushing system consists of a control panel 12, a flush valve 14, a fresh water conduit 16, and fresh water hoses 18, 19, 20. The control panel 12 of the flushing system 10 is attached to the interior portion 30 of a boat 32 and in close proximity to the marine engine 28. The fresh water hoses 18, 19, 20 are interconnected between the fresh water flush valve 14 and the raw sea water cooling conduit 26 (illustrated in FIGS. 6–11) of the marine engine 28. A plurality of T-shape tubular interconnections (not illustrated in this figure) are used to connect the fresh water hoses to the raw sea water cooling conduit in order to provide for fresh water to flow from the fresh water hoses into the sea water cooling conduit.

Figure 2:
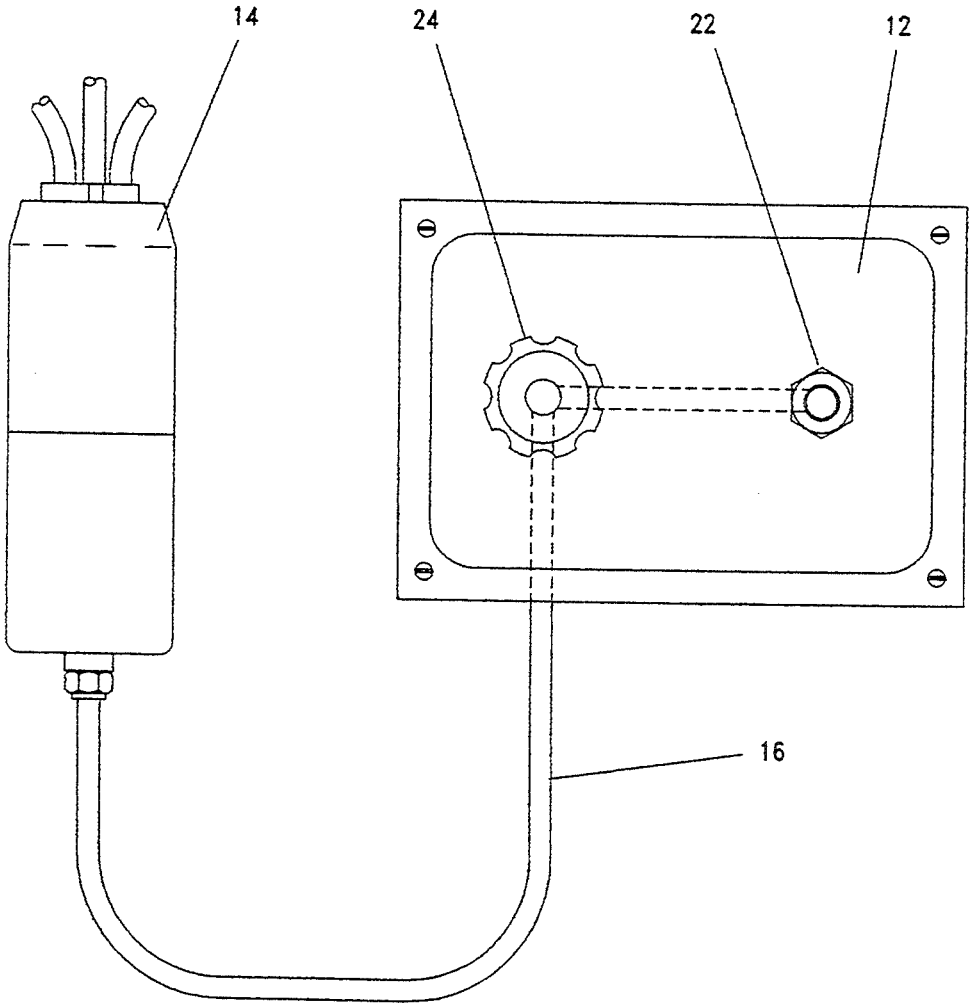
FIG. 2 is a conceptual flow schematic showing the control panel having a fresh water connection and a gate valve.

The control panel is illustrated in further detail in FIG. 2. As seen in this figure, the control panel 12 includes a fresh water supply connector 22 and a gate valve 24. The fresh water supply connector 22 is connected to the fresh water conduit 16 (illustrated in outline) and is also adapted to receive a dockside source of fresh water (not illustrated). The source of fresh water (for example a standard hose line) is attachable to and detachable from the fresh water supply connector 22 and allows for fresh water to flow freely into the fresh water conduit 16. This fresh water conduit 16 also interconnects with the gate valve 24 and the fresh water flush valve 14. The gate valve 24 regulates and modulates the flow of fresh water, from its source of fresh water through the fresh water conduit 16.

Figure 3:
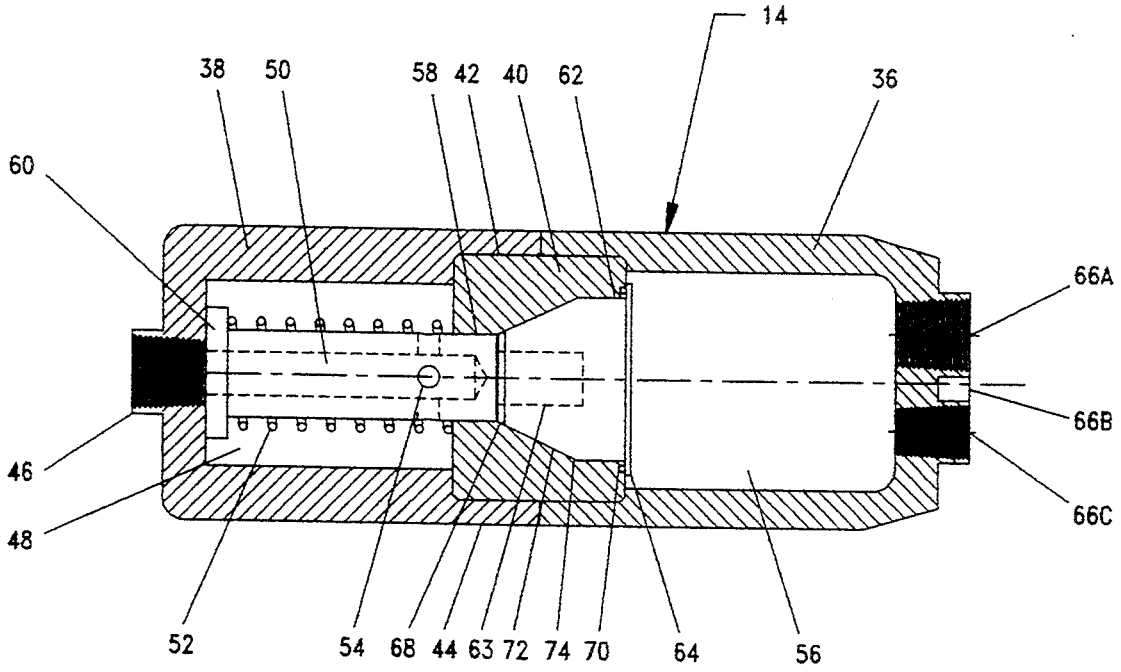
FIG. 3 is a longitudinal cross-sectional view of the proportioning flush valve used in the flushing system of the present invention.
Figure 4:
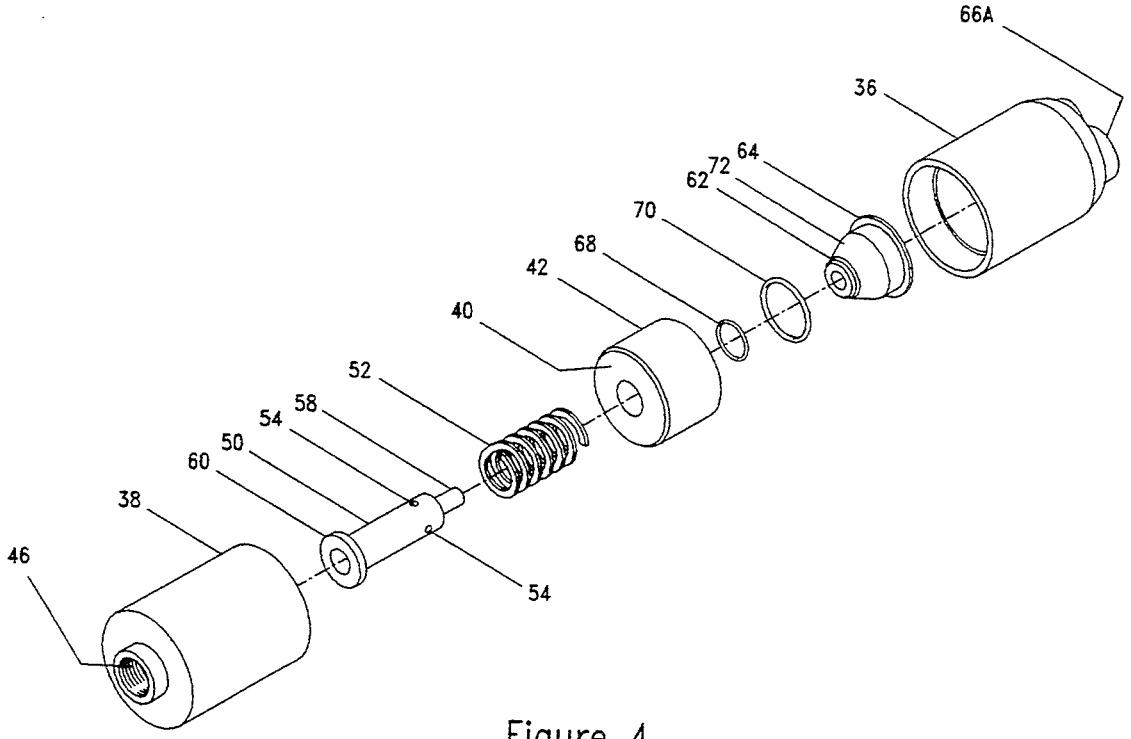
FIG. 4 is an exploded longitudinal perspective view of the proportioning flush valve showing the components of the flush valve prior to assembly.

The fresh water valve is illustrated in further detail in FIGS. 3 and 4. As seen in these figures, the fresh water valve 14 has an upper body member 36, lower body member 38, and a valve interface member 40 having an outer surface 42. The upper body member and the lower body member are permanently attached to the outer surface of the valve interface member for forming the outer shell 44 of the fresh water flush valve 14. The attachment of the upper and lower body members to the interface member can be accomplished by 14 pressure treatment and the use of adhesives.

The lower body member 38 further includes an inlet port 46 for receiving the fresh water conduit (not illustrated in these figures) in order to establish fluid flow between the fresh water conduit and the fresh water flush valve 14.

Located within the lower body member 38 of the fresh water valve 14 is a cavity 48. Within the cavity 48 is a valve plunger 50 and a bias spring 52. This bias spring 52 is disposed helically around the valve plunger and surrounds the valve plunger 50 from a normally closed position at zero fresh water pressure to a coiled biased open status when the fresh water pressure is sufficiently increased. FIG. 3 illustrates the fresh water valve in a closed position.

The valve plunger has a transverse set of discharge ports 54, for establishing proportional fresh water fluid flow through the fresh water inlet port to an interior chamber 56 of the upper valve body. The valve plunger and set of discharge ports 54 are illustrated in further detail in FIGS. 5*a*, 5*b*, and 5*c*. The valve plunger 50 further includes an upper portion 58 and a lower portion 60. The lower portion extends outwardly and contacts the lower body member when the valve plunger is in a closed position (as illustrated in FIG. 3).

A valve plug 62 is located within the valve interface member 40. This valve plug 62 has a recessed portion 63. The recessed portion 63 receives and contacts the upper portion 58 of the valve plunger. The valve plug also has a lip portion 64 which contacts the valve interface member. In this configuration, any displacement of the valve plunger will result in an equal displacement of the valve plug. Additionally, the valve plug includes a tapered end which forms a conical outer surface 72 which contacts the inner surface 74 of the valve interface 40.

The upper body member 36 of the flush valve receives the valve plunger in the cavity 56 when the flushing system is in use (not illustrated in these figures). The upper body member further includes a plurality of outlet ports **66*a*, 66*b*, 66*c***, for receiving the fresh water hoses (not illustrated in these figures).

When fresh water pressurizes the valve plunger 50, the valve plunger 50 moves linearly to establish fresh water fluid flow communication between the transverse set of discharge ports 54 and the interior chamber of the upper body member, and the spring is compressed to a biased status.

It is illustrated in these FIGS. (3 and 4) when the fresh water pressure is relieved, the status of the spring 52 is reversed, returning the spring 52 to an extended, normally closed status. The plunger 50 also returns linearly to its normally closed position and disconnects the fresh water fluid flow communication between the transverse set of discharge ports and the interior chamber of the upper valve body.

A first O-ring 68 is located inside the valve interface 40 and contacts the valve plunger 50. A second O-ring 70 is located inside the valve interface 40 and contacts the lip portion 64 of the valve plug 62. These O-rings provide adequate sealing means to restrict back flow of fresh water to the control panel when the flushing process is completed. When the flushing system is not in use, the first and second O-rings prevent sea water from entering the control panel.

The tapered end which forms a conical outer surface 72 of the valve interface 40, contacts the inner surface of the valve interface to further close off back flow of fresh water to the control panel after the flushing process is completed. The back flow restriction is important when the marine engine (not illustrated in these figures) is in use and in operation on the high seas, and the flushing system is inoperative. If back flow were to occur under normal operating conditions, the sea water would infiltrate through the flushing system and result in malfunction of the system and possible harm to the occupants of the boat.

Figure 5A:
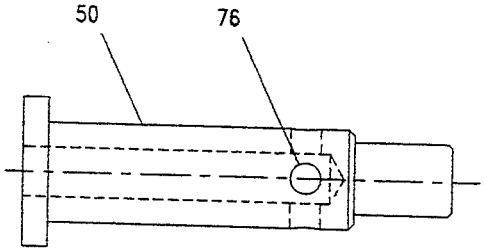
FIGS. 5*a*–5*c* are various views of the valve plunger used in the flushing system of the present invention.
Figure 5C:
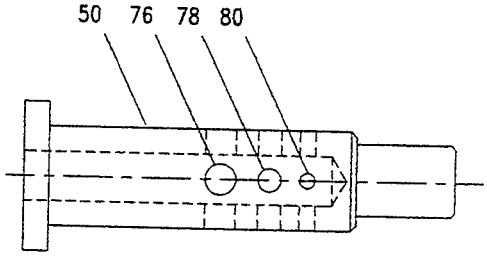
Figure 5B:
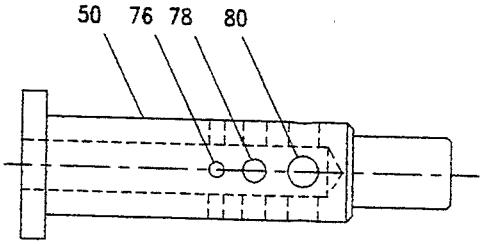
Figure 6:
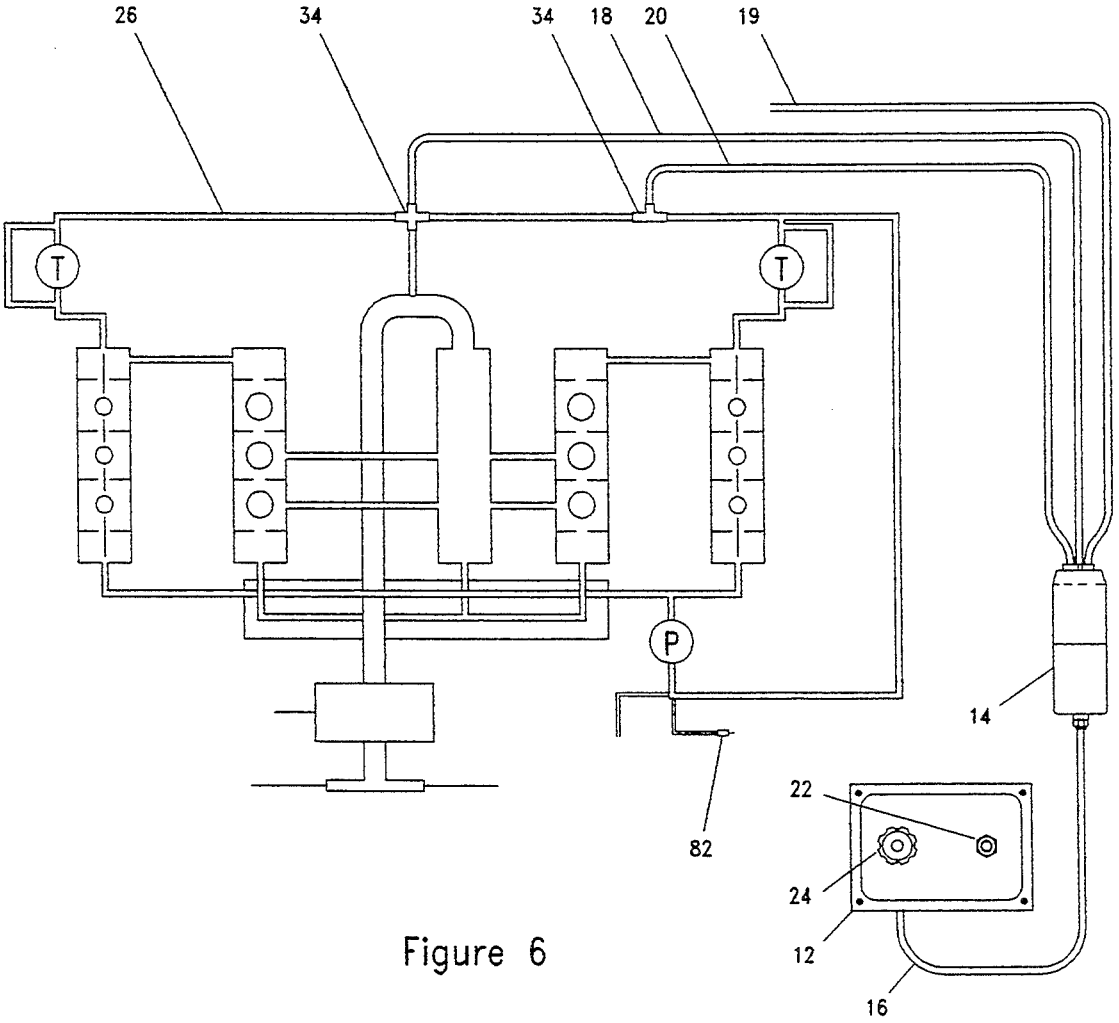
FIG. 6 is a conceptual flow diagram showing the interconnection of the proportion flush valve system to a typical raw sea water cooling conduit for a typical outboard marine engine.

FIGS. 5*a*, 5*b*, and 5*c* illustrate the valve plunger and the set of discharge ports in further detail. In FIG. 5*a* a valve plunger 50 includes the first design for the set of discharge ports. This design includes a first hole 76 to be used for each set of discharge ports. Each set of discharge ports are transverse from the axis of the valve plunger and are spaced 90 degrees apart from one another. By varying the bias spring's (not illustrated) progression rate, the first hole allows for a controlled output pressure of fresh water from the outlet ports in the upper body member.

In FIG. 5*b*, the valve plunger 50 includes the second design for the set of discharge ports. This design provides that the set of discharge ports includes a first hole 76, a second hole 78 having a diameter larger than the first hole, and a third hole 80 having a diameter larger than the second hole. Each set of discharge ports are transverse from the axis of the valve plunger and are spaced 90 degrees apart from one another. In this embodiment, the fresh water enters the inlet port on the flush valve at a preset maximum pressure level and exits the outlet ports of the flush valve at a preset minimum pressure level.

In FIG. 5*c*, the valve plunger 50 includes the third design for the set of discharge ports. This design provides that the set of discharge ports includes a first hole 76, a second hole 78 having a diameter smaller than the first hole, and a third hole 50 having a diameter smaller than the second hole. Each set of discharge ports are transverse from the axis of the valve plunger and are spaced 90 degrees S apart from one another. In this embodiment, the volume and pressure of the fresh water flowing into and out of the flush valve can be controlled and customized.

As seen in FIGS. 5*b* and 5*c*, each set of holes is horizontally aligned.

Figure 11:
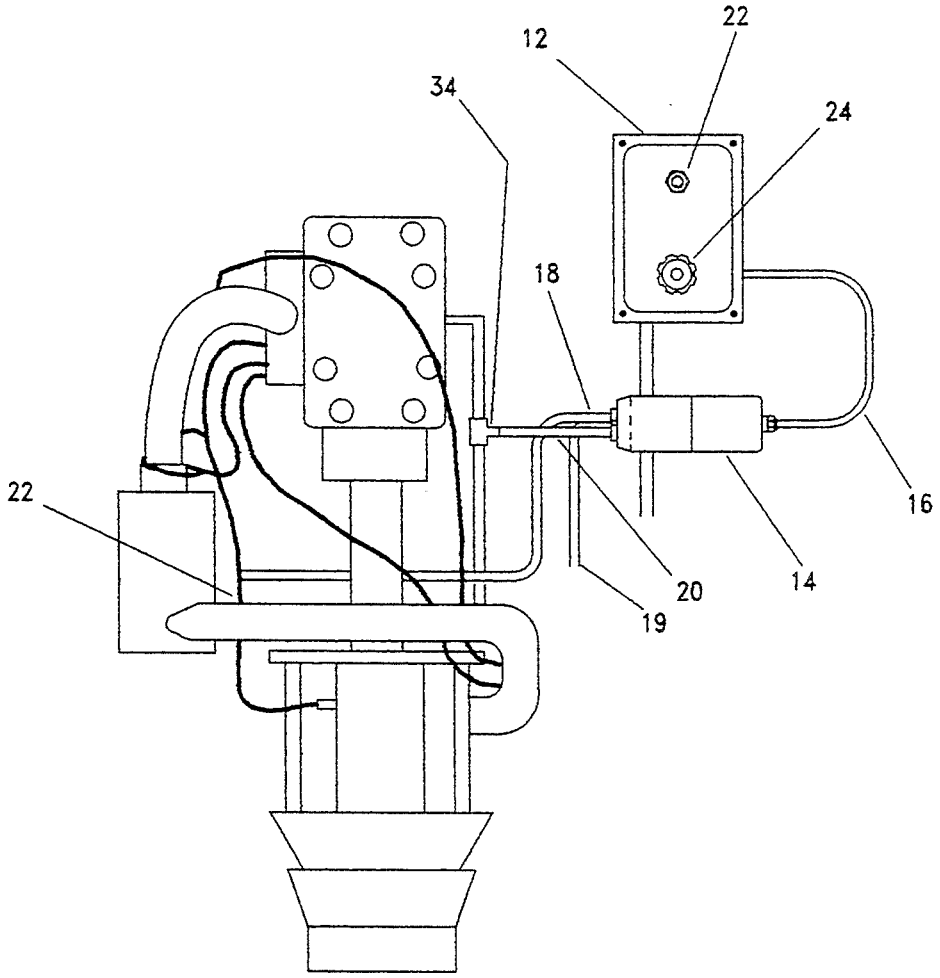
FIG. 11 is a conceptual flow diagram showing the proportioning flush valve interconnecting to the raw sea water cooling conduit of a jet ski marine engine.

The flushing system of the present invention can be 4 used with a variety of marine engines. For example the flushing system can be utilized with outboard marine engines (FIG. 6), V-8 stern drive marine engines (FIG. 7), V-8 inboard marine engines (FIG. 8), four cylinder stern drive marine engines (FIG. 9), four cylinder stern drive marine engines having a closed cooling system (FIG. 10), and jet ski marine engines (FIG. 11). As seen in FIGS. 6–11, the control panel 12 includes a fresh water supply connector 22, and a gate valve 24. A fresh water conduit 16 interconnects with the fresh water supply connector, the gate valve, and the flush valve 14. A plurality of fresh water hoses 18,29,20 are connected with the flush valve 14. The fresh water hoses are then connected with the sea water conduit 26 by T-shape tubular interconnections 34 (illustrated in FIGS. 6 and 11). Fresh water is then able to flush the marine engine.

Figure 7:
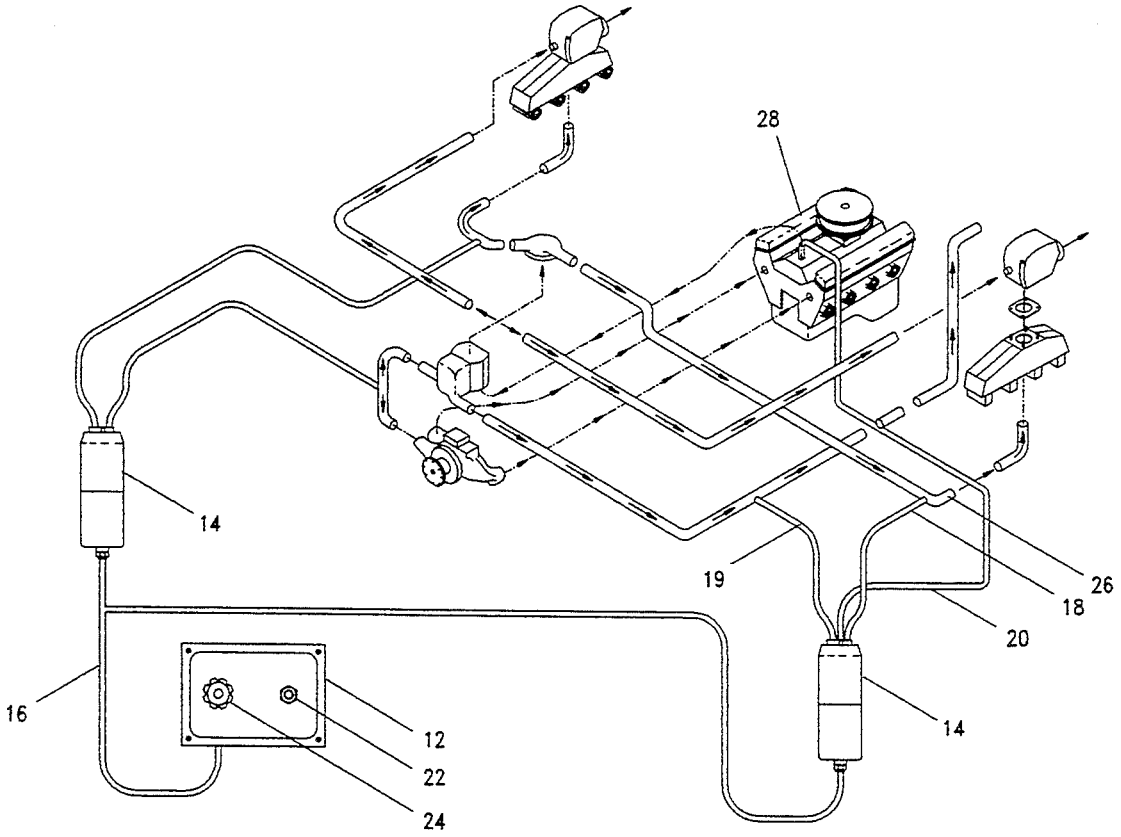
FIG. 7 is a conceptual flow diagram of the invention showing a plurality of proportioning flush valves interconnecting to a raw sea water cooling conduit of a typical V-8 stern drive marine engine.
Figure 8:
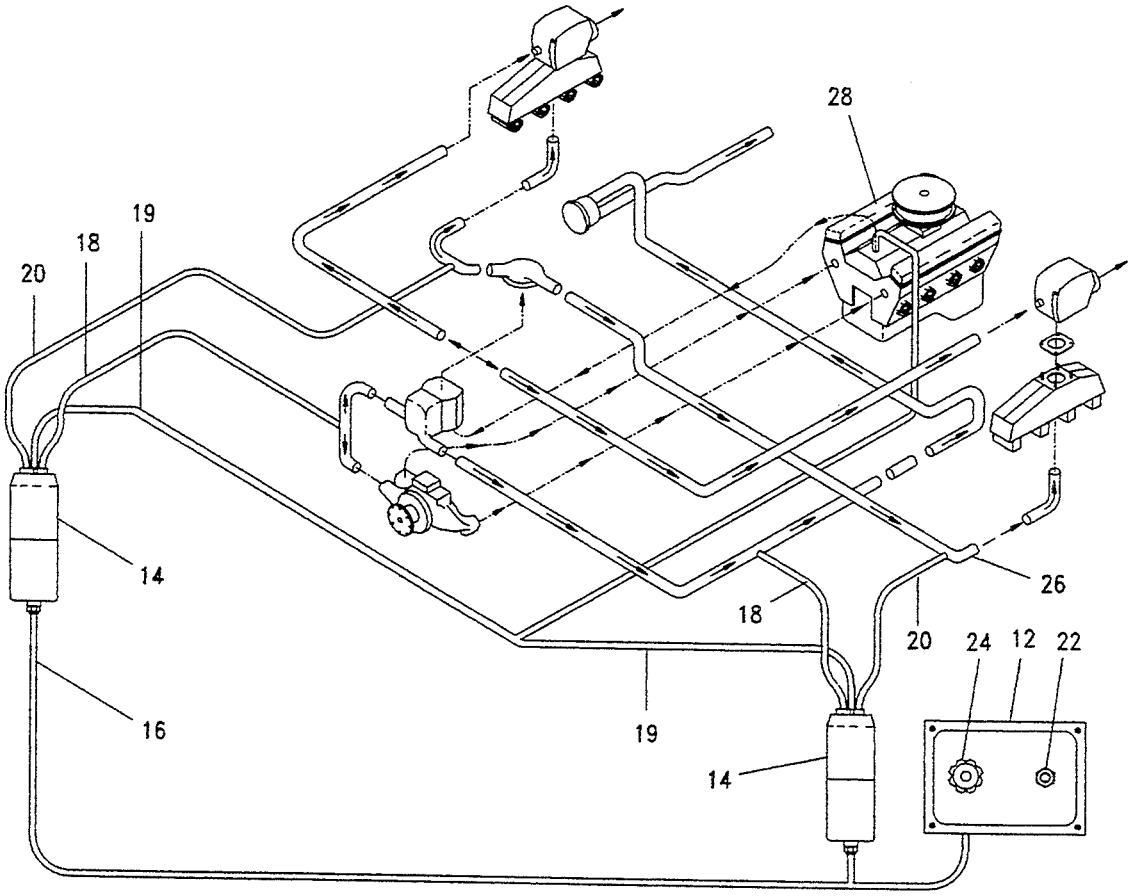
FIG. 8 is a conceptual flow diagram of the present invention showing the plurality of proportioning flush valves interconnecting to the raw sea water cooling conduit of a typical V-8 inboard marine engine.
Figure 9:
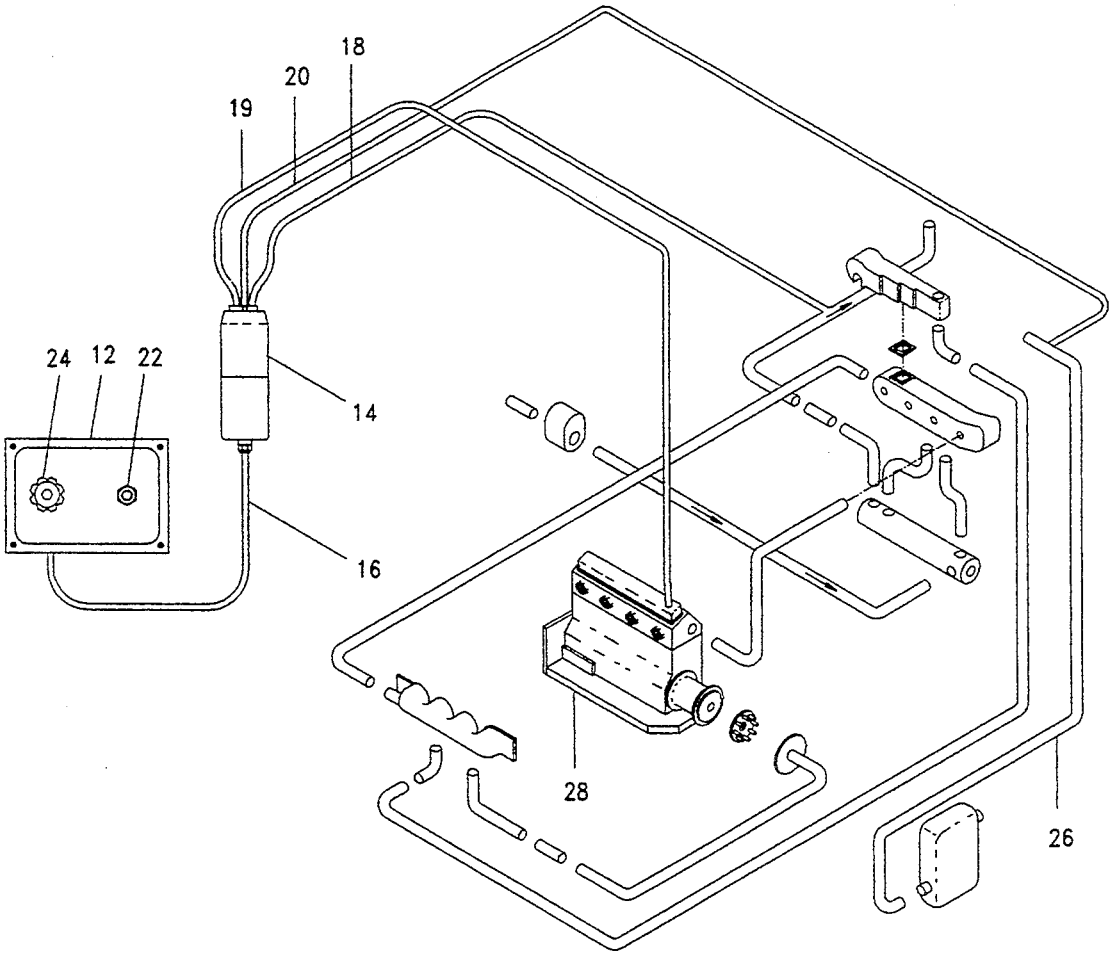
FIG. 9 is a conceptual flow diagram showing the proportioning flush valve interconnecting to the raw sea water cooling conduit of a typical four cylinder stern drive marine engine.
Figure 10:
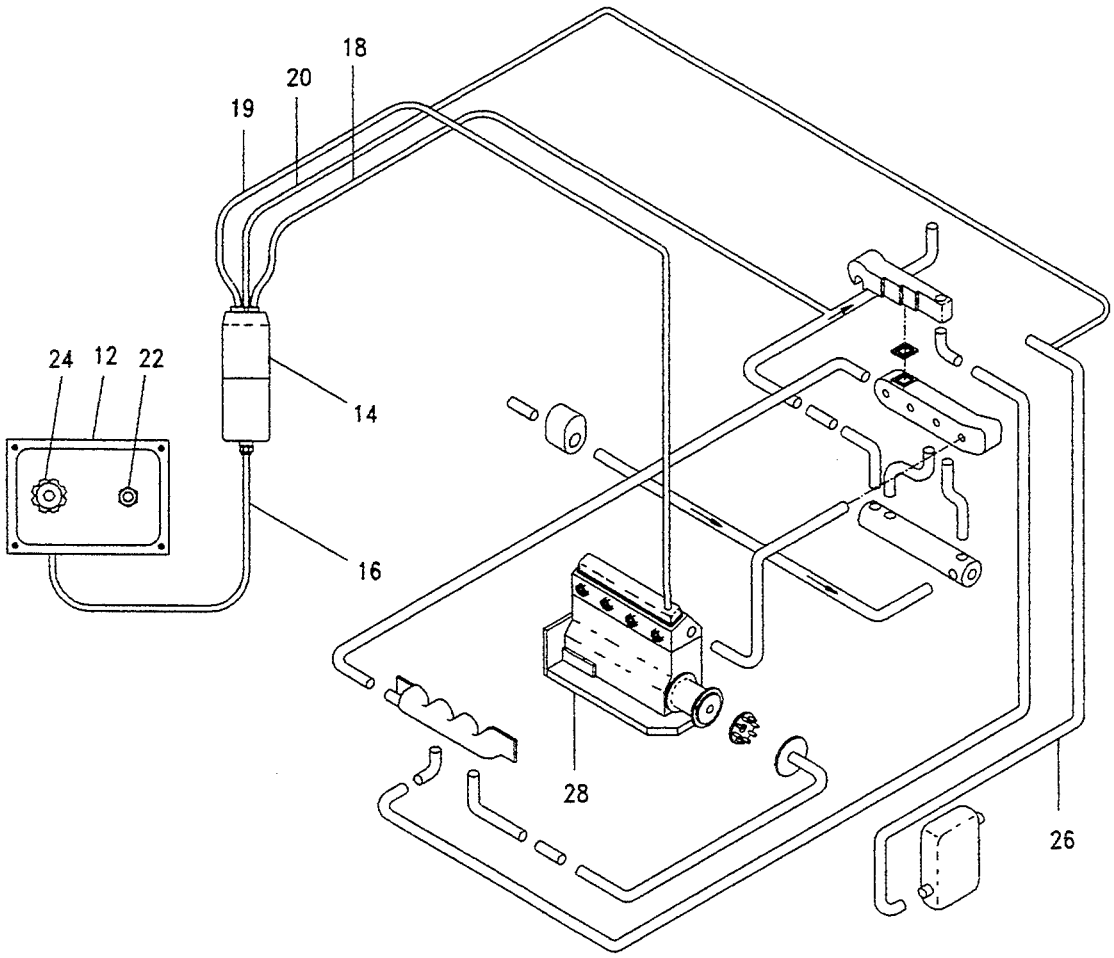
FIG. 10 is a conceptual flow diagram showing the proportioning flush valve interconnecting to the raw sea water cooling conduit of a typical four cylinder stern drive marine engine having a closed cooling system.

Certain types of engines, particularly inboard engines and stern drive engines, have very complex cooling systems. In the above cited cases, a plurality of flush valves 14 are deployed to properly proportion the fresh water flow to all of the engine cooling sub-systems and components, as best seen in FIGS. 7 and 8.

In FIG. 11, hose 19 is directly connected to an access point on the impeller housing (not illustrated).

To utilize the flushing system of the present invention, as illustrated in FIGS. 1–12, a fresh water line, such as a hose (not illustrated), would be attached to the fresh water supply connector 22. This would allow fresh water to flow into the fresh water conduit. The gate valve 24 on the control panel is rotated to an open position thereby establishing a pressurized fresh water flow to the fresh water flushing valve 14 through a fresh water conduit 16. The fresh water then enters the flush valve through the inlet port on a lower body member. The fresh water pressure moves the valve plunger to an open status and the fresh water flows through an inlet port and then through the set of discharge ports which are disposed transversely on the valve plunger into an interior chamber of an upper body member of the fresh water flush valve 14.

The fresh water discharges from the upper valve body through a plurality of axial outlet ports, and enters the raw sea water cooling conduit 26 through a plurality of T-shape tubular interconnections 34. The fresh water transits the raw sea water cooling conduit and flushes the entrained sea water through a nozzle 82 (illustrated in FIG. 6).

When fresh water is detected exiting the nozzle 82, the operator closes the gate valve on the control panel. The spring biased plunger and the valve plug then return to a closed position as the pressure in the flush assembly returns to zero. The spring extends to an uncoiled biased status and returns the valve plunger to a closed position. The first and second O-rings act harmoniously to disconnect the fresh water fluid flow communication and eliminate any back flow of fluid to the control panel.

The major advantage of the flushing system of the present invention over previous fresh water flushing systems is the ability to flush the entrained sea water from the raw sea water cooling conduit 26 without pulling the boat from the water. The owner can operate the flushing system of the present invention while the boat is in a slip with the engine off.

Fresh water flushing is recommend universally by every engine manufacturer. The fresh water flushing of a marine engine prolongs the life of the equipment, lowers the maintenance cost, and protects the significant investment in the engine itself. This ease of operation will encourage more frequent flushing of the raw sea water cooling conduit and hence, significantly increase the reliability of the engine and the safety of the boat's occupants. Engine life will be increased significantly since corrosion of the engine will be dramatically retarded.

While the invention has been particularly shown and described with reference to an embodiment thereof, it will be understood by those skilled in the art that various changes in form and detail may be made without departing from the spirit and scope of the invention.

I claim:

1. A fresh water flushing system for a marine engine in a boat for use whether said boat is in or out of a body of water comprising in combination:

a control panel;

said control panel is mounted interiorly on said boat;

said control panel includes a fresh water supply connector and a gate valve;

said fresh water supply connector includes a means for attaching and detaching a pressurized fresh water fluid line in order to allow for a flow of fresh water to enter into said control panel when said pressurized fresh water fluid line is attached to said fresh water supply connector;

said gate valve regulates said flow of fresh water;

a fresh water flush valve;

said fresh water flush valve has a fresh water inlet port for receiving said flow of fresh water and a plurality of outlet ports for discharging said flow of fresh water;

said fresh water valve includes an upper body, a lower body, and a valve interface;

said valve interface includes an outer surface and an inner surface;

said upper body and said lower body are permanently attached to said outer surface of said valve interface;

said upper body and said lower body completely surround and house said valve interface;

said upper body has an interior chamber and includes said plurality of outlet ports;

said lower body has a cavity;

said cavity houses a valve plunger;

a biased helical spring surrounds said valve plunger;

a fresh water conduit;

said fresh water conduit is adapted for urging said flow of fresh water between said control panel and said fresh water flush valve;

a plurality of tubular interconnection fittings;

each of said plurality of tubular interconnection fittings have a T-shape for urging said flow of fresh water between said fresh water flush valve to a raw water cooling conduit of said marine engine;

said raw water cooling conduit contains and maintains water flow from said body of water;

a plurality of hoses;

said plurality of hoses are connected to said plurality of outlet ports of said fresh water flush valve;

said plurality of hoses are connected to said plurality of tubular interconnection fittings; and said plurality of hoses are adapted for urging said flow of fresh water between said fresh water flush valve to said raw sea water cooling conduit.

2. The fresh water flushing system as in claim 1 wherein said valve plunger further includes a first set of transverse discharge ports, a second set of transverse discharge ports, a third set of transverse discharge ports, and a fourth set of transverse discharge ports for urging said flow of fresh water from said fresh water inlet port to said interior chamber of said upper body;

said first set of transverse discharge ports is located 90 degrees from said second set of transverse discharge ports;

said second set of transverse discharge ports is located 90 degrees from said third set of transverse discharge ports;

said third set of transverse discharge ports is located 90 degrees from said fourth set of transverse discharge ports;

said fourth set of transverse discharge ports is located 90 degrees from said first set of transverse discharge ports;

said first set of transverse discharge ports, said second set of transverse discharge ports, said third set of transverse discharge ports, and said fourth set of transverse discharge ports each consists of first hole, a second hole, and a third hole;

said first hole has a first diameter;

said second hole has a second diameter;

said third hole has a third diameter;

said second diameter is larger than said first diameter; and said third diameter is larger than said second diameter.

3. The fresh water flushing system as in claim 1 wherein said valve plunger further includes a first set of transverse discharge ports, a second set of transverse discharge ports, a third set of transverse discharge ports, and a fourth set of transverse discharge ports for urging said flow of fresh water from said fresh water inlet port to said interior chamber of said upper body;

said first set of transverse discharge ports is located 90 degrees from said second set of transverse discharge ports;

said second set of transverse discharge ports is located 90 degrees from said third set of transverse discharge ports;

said third set of transverse discharge ports is located 90 degrees from said fourth set of transverse discharge ports;

said fourth set of transverse discharge ports is located 90 degrees from said first set of transverse discharge ports;

said first set of transverse discharge ports, said second set of transverse discharge ports, said third set of transverse discharge ports, and said fourth set of transverse discharge ports each consists of first hole, a second hole, and a third hole;

said first hole has a first diameter;

said second hole has a second diameter;

said third hole has a third diameter;

said second diameter is smaller than said first diameter; and said third diameter is smaller than said second diameter.

4. The fresh water flushing system as in claim 2 wherein each of said first holes, said second holes, and said third holes of said first set of transverse discharge ports, said second set of transverse discharge ports, said third set of transverse discharge ports, and said fourth set of transverse discharge ports are horizontally aligned.

5. The fresh water flushing system as in claim 3 wherein each of said first holes, said second holes, and said third holes of said first set of transverse discharge ports, said second set of transverse discharge ports, said third set of transverse discharge ports, and said fourth set of transverse discharge ports are horizontally aligned.

6. A fresh water flushing system as in claim 2 wherein said inner surface of said valve interface further includes a valve plug; and said valve plug has a recess for receiving a first end of said plunger for urging equal motion of said valve plunger and said valve plug.

7. A fresh water flushing system as in claim 6 wherein said valve plug includes a top portion and a bottom portion;

said top portion faces said outlet ports of said fresh water flush valve;

said bottom portion faces said fresh water inlet port; and said top portion of said valve plug includes an encompassing lip extending outwardly and contacting said valve interface for restricting said water flow to enter said control panel when said fresh water flushing system is not in use and operation.

8. A fresh water flushing system as in claim 7 wherein said bottom portion of said valve plug has a conical tapered shape for urging secure releasable engagement with said inner surface of said valve interface for restricting said water flow to enter said control panel when said fresh water flushing system is not in use and operation.

9. A fresh water flushing system as in claim 8 wherein a first O-ring surrounds said upper portion of said valve plug and contacts said encompassing lip.

10. A fresh water flushing system as in claim 9 wherein a second O-ring surrounds said lower,portion of said valve plug and contacting said valve plunger.

* * * * *